United States Patent [19]

Hudd

[11] 4,252,178

[45] Feb. 24, 1981

[54] CONTINUOUS CASTING MOLD WITH RESILIENTLY HELD GRAPHITE LINER MEMBERS

[75] Inventor: Anthony W. Hudd, Sutton Coldfield, England

[73] Assignee: IMI Refiners Limited, Staffordshire, England

[21] Appl. No.: 906,252

[22] Filed: May 15, 1978

[30] Foreign Application Priority Data

May 19, 1977 [GB] United Kingdom ..... 21114/77

[51] Int. Cl.[3] ..... B22D 11/04

[52] U.S. Cl. ..... 164/435; 164/444

[58] Field of Search ..... 164/415, 418, 435, 443, 164/444

[56] References Cited

U.S. PATENT DOCUMENTS

| | | | |
|---|---|---|---|
| 3,157,921 | 11/1964 | Porter | 164/443 |
| 3,599,706 | 8/1971 | Wieland | 164/435 |
| 3,809,148 | 5/1974 | Pulsifer | 164/443 X |

FOREIGN PATENT DOCUMENTS

| | | | |
|---|---|---|---|
| 1814144 | 6/1960 | Fed. Rep. of Germany . | |
| 1265924 | 4/1968 | Fed. Rep. of Germany . | |
| 6930847 | 8/1969 | Fed. Rep. of Germany . | |
| 51-38234 | 3/1976 | Japan | 164/435 |
| 910695 | 11/1962 | United Kingdom . | |
| 924758 | 5/1963 | United Kingdom . | |
| 962259 | 7/1964 | United Kingdom | 164/435 |
| 1019746 | 2/1966 | United Kingdom . | |
| 1051291 | 12/1966 | United Kingdom . | |
| 1109399 | 4/1968 | United Kingdom . | |
| 1200558 | 7/1970 | United Kingdom | 164/443 |
| 1277312 | 6/1972 | United Kingdom . | |

*Primary Examiner*—Robert D. Baldwin

*Attorney, Agent, or Firm*—Cushman, Darby & Cushman

[57] ABSTRACT

A continuous casting slab mould including a cooled copper body containing an aperture lined with graphite liners in which the graphite liners are held against the copper body by means of springs interengaging the liner and the body.

16 Claims, 4 Drawing Figures

CONTINUOUS CASTING MOLD WITH RESILIENTLY HELD GRAPHITE LINER MEMBERS

BACKGROUND OF THE INVENTION

This invention relates to moulds and has particular reference to open ended continuous casting moulds.

Continuous casting moulds basically comprise an open ended box into which molten metal is poured at one end and from which solid rod, slab or tube is extracted at the other end, the metal solidifying within the mould on a continuous basis. The system incorporating the mould is so arranged that the withdrawal speed of solidified metal at the bottom of the mould exactly equals the inflow of molten metal at the top so that the mould is in a steady state. Continuous casting moulds are, of course, totally different from ordinary moulds in which metal is poured into the mould to fill it and solidification takes place within the mould, the solidified metal then being removed from the mould in one piece.

Although in theory a very simple concept, continuous casting has proved to be quite difficult to utilise in commercial practice. There is a considerable amount of technology needed to manufacture and use continuous casting moulds on a commercial basis. There are a number of moulds in commercial use and there are very many more moulds which have been proposed although never used in practice.

In British Pat. No. 822,578 there is disclosed a continuous casting slab mould which utilises thin graphite sheets connected at their top and bottom edges only to a thin copper backing sheet. The specification states that because of the temperature differences across both the graphite and the copper the graphite and copper will distort in such a manner as to form a very good thermal contact between the graphite and copper. Unfortunately, however, graphite creeps at high temperature such that the stress between the graphite and copper can relax in use, permitting the graphite to move away from the copper sufficiently to increase dramatically the thermal resistance of the graphite copper interface. One of the significant problems about graphite lined moulds relates to the air gap which normally exists between the copper and graphite. At a temperature of 500° C. air has a thermal resistance 7500 times that of copper and this means that, for example, an air gap of 0.001 in would correspond to a thickness of 7½ in of copper.

There are a number of continuous casting moulds used in practice in copper refining but although they have their advantages they also suffer from a number of disadvantages. In one known mould, which is a solid copper block having water cooling channels bored in it, a mould cavity being chromium plated and all of the primary water impinging on the withdrawing slab, has an advantage in that it is robust. Unfortunately it requires continuous lubrication to prevent adhesion between the cavity wall and the product. The lubricant causes product surface imperfections reducing yield.

Lubrication addition rates significantly less than the norm greatly exacerbates the adhesion problems resulting in a safety hazard.

The mould described in British Pat. Nos. 853,853 and 853,854 is a complex integral water-cooled graphite block.

Another type of mould is basically a copper inner box with an outer steel water jacket, there being 4 graphite plates forming a lining in the mould cavity.

A further mould utilises 4 graphite blocks bound together to form the mould cavity, with either a wide copper sheet pulled tight with a turn buckle or a copper tape tightly helically wound round the outside of the composite. Water is sprayed from a manifold onto the copper binding and secondary cooling is provided by a separate circuit.

Yet another mould basically comprises an inner copper mould with an outer steel water jacket in two pieces which bolt together to form a water cooling circuit. All the primary cooling water passes through holes at the base of the mould to impinge on the withdrawing slab thus becoming secondary cooling water. This gives advantages in that the design is simple but unfortunately the casting rate is low, the mould is prone to mechanical damage and also prone to distortion.

SUMMARY OF THE INVENTION

By the present invention there is provided a slab mould for a continuous casting machine including a body of a metal having high conductivity, means to cool the body, the body having an internal cavity in which is located a series of graphite slab liner members, characterised in that the graphite slab liner members are resiliently held in contact with the body by a plurality of spring-biased means secured to each of the graphite slab liner members over the area of each slab.

Preferably the metal of the body is copper. Preferably the graphite slabs are provided with blind holes in their back faces, which holes are tapped and into which are screwed rod members which pass through holes in the body and are secured to the body by resilient means, such as coil springs in compression.

The interface pressure is preferably in the range 1–5 lbf/in$^2$, further preferably in the range 1½–3½ lbf/in$^2$ or 2 or 3 lbf/in$^2$. There may be as many springs as can be provided without destroying the mould liners or body.

Further, the cross-sectional area of the mould is smaller at the exit end than at the inlet end. The slab liners may be tapered in thickness to provide the tapering cross-sectional area. The copper body preferably has coolant channels formed within the solid body. The coolant channels preferably contain internal rod(s) spaced from the walls of the coolant channels. The slab mould may be rectangular or square. Preferably the corners of the mould are internally radiussed. In the case of rectangular moulds, the major axis may have a plurality of graphite slab liner members. There may be provided resiliently biassed end loading means to maintain intimate contact of the plurality of graphite slabs in the major axis.

The radius may be formed by the corner slab liner portions having a substantially L-shape in cross-section and extending around the corner to engage further liner portions away from the corners. Further there may be provided channels in the copper body or graphite liners so that a purge gas may be fed into the graphite/copper interface gap. The purge gas may be hydrogen but is preferably helium.

The coolant may be water and the coolant may be released at the bottom of the mould to spray onto the emerging solidified slab. The mould may be reciprocated in use, in a direction parallel to the casting direction.

BRIEF DESCRIPTION OF THE DRAWINGS

By way of example embodiments of the present invention will now be described with reference to the accompanying drawings of which.

DESCRIPTION OF THE PREFERRED EMBODIMENTS

Figure 1:
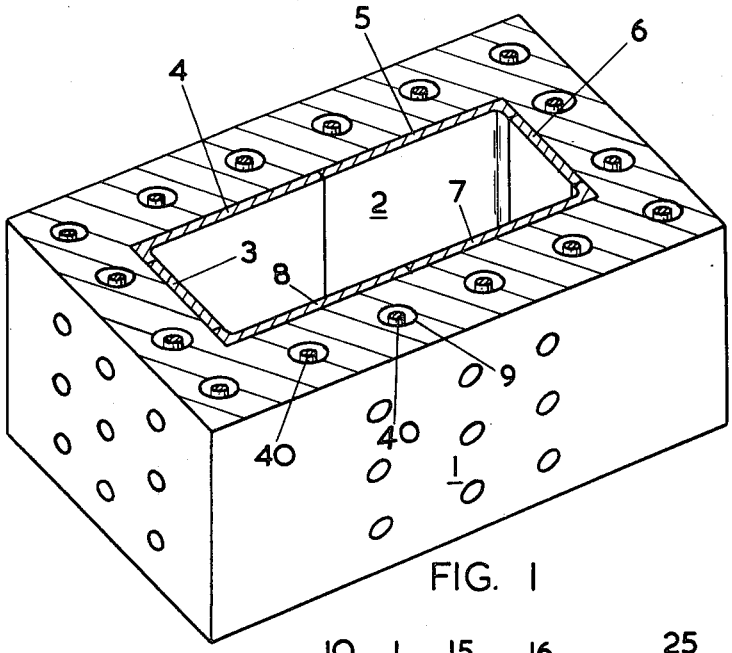
FIG. 1 is a perspective view partly in section of a mould in accordance with the invention.

Referring to FIG. 1 this shows a perspective view of a mould which includes a number of components. The body of the mould comprises an open-ended copper box 1 having a bore 2 in which is located a graphite liner having a number of parts such as 3, 4, 5, 6, 7 and 8. The copper body contains a number of coolant channels 9 through which, in use, water is pumped to cool the body. As can be seen in FIG. 1 the graphite plates 3 to 8 which form the liner are either completely rectangular such as plates 3 and 6 or are L-shaped in cross-section such as plates 4, 5, 7 and 8. The copper block 1 can either be in the form of an integral casting or can be manufactured in three or four portions and bolted together as required. The means to retain the graphite slabs in the copper body is shown more clearly in FIGS. 2, 3 and 4.

Figure 2:
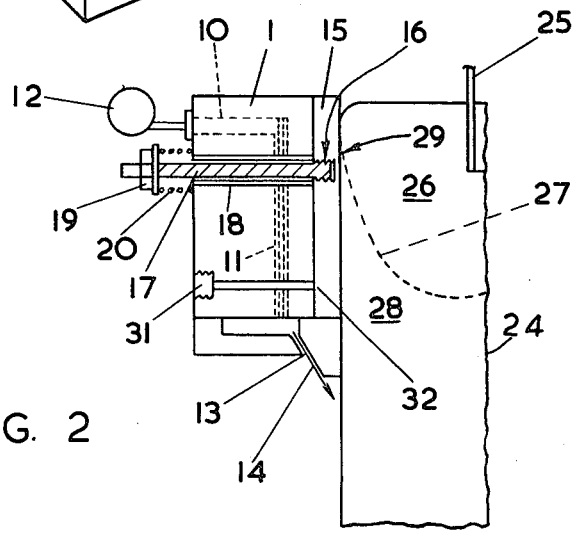
FIG. 2 is a part sectional view of the mould of FIG. 1.
Figure 3:
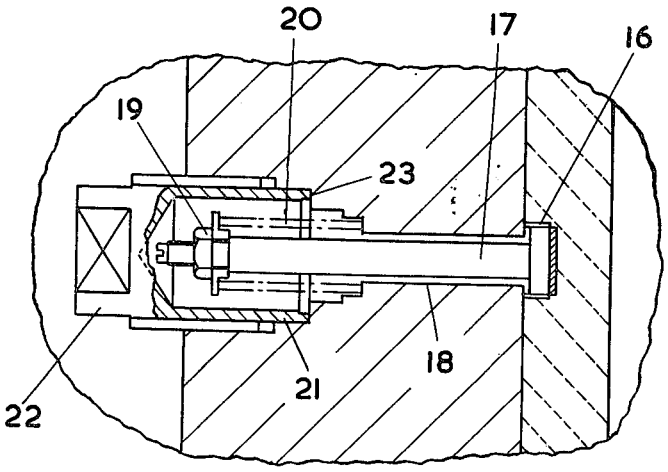
FIG. 3 is a part sectional view in more detail of a spring-loaded clamp.

Referring to FIG. 2 the copper body 1 has bored in it channels 10 and 11 through which coolant water passes from a manifold 12 to be sprayed out through slot 13 in the direction of the arrow 14 onto the emerging solidified metal. The graphite slab 15 has bored in it over the area of its surface a number of blind holes 16 into which are screwed bolts 17. These bolts pass through corresponding holes 18 in the copper body and are provided with nuts 19 which compress coil springs 20 to resiliently bias the bolts 17 outwardly and to pull the graphite liner 15 firmly into contact with the copper body 1.

The arrangement of the bolt and spring may be recessed into a tapped hole 21 in the body and the tapped hole may contain a blanking plug 22 which is screwed into the hole 21 and sealed by means of a sealant ring 23 to restrict oxidation of the graphite plates. It will be appreciated that the graphite parts of the mould operate at a high temperature in use and if no attempt were made to restrict oxidation of the plates in the region of the holes 16, then bolts 17 would become detached from the graphite resulting in loss of contact pressure between graphite and copper.

The drawing FIG. 2 shows a half of a mould in cross-section, the centre line of the mould and metal being cast is given at 24. Molten metal, in this case copper, is fed in through a tube 25 into the mould and remains liquid in the portion 26 above the solid liquid interface indicated by the dashed line 27. The mould is reciprocated up and down in use to increase the contact resistance between the tapered slab 15 and the solidifying portion 28 of the copper being cast. The reciprocation also ensures that the interface between the solid copper edge 29 and the mould liner 15 remains clean and unaffected by dross. There is also provided in the copper body 1 a hole bored through the body and provided with a tapped inlet 31 and interconnecting with a groove 32 at the copper to graphite interface. Through this bore helium can be inserted to purge the gap between the copper and graphite to increase heat transfer across the gap. It has been found that the use of helium to replace air which would otherwise exist in the very small gap can increase the thermal performance of the mould by up to 16% overall. This means that with an existing mould 16% more metal may be cast through it thereby considerably increasing the productivity of the casting equipment.

Figure 4:
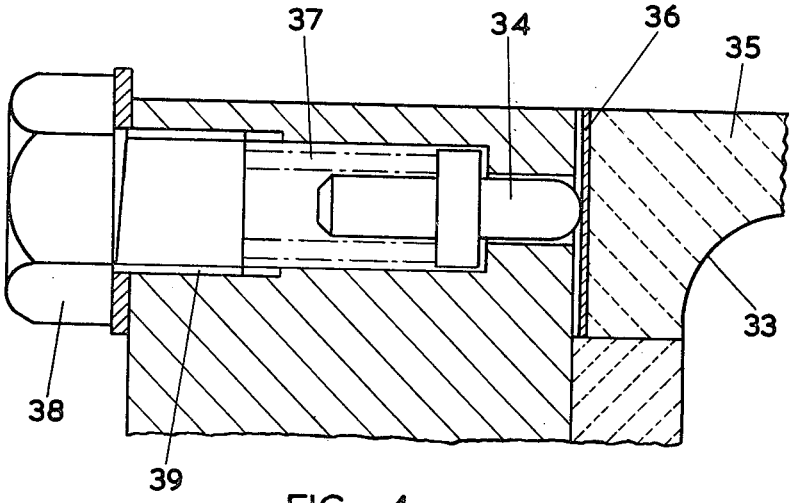
FIG. 4 is a part sectional view in more detail of an end clamp.

Referring to FIG. 4 this shows in more detail the L-shaped cross-section of one end of the graphite slabs and it can be seen that there is provided a radius 33 on the inside corner of the graphite slab which means that the slab has rounded corners after solidification. This is very important with fully continuous casting equipment. Since it is conventional practice to pass the cooling water over the exterior of the slab as cast this water has to be removed before the slab can pass to the normal handling, such as saw cutting etc., equipment. With continuous casting, therefore, it is necessary to provide a seal which prevents water passing along the metal being cast. In practice it has been found that it is extremely difficult to provide such a seal when the corners of the slab meet at exact right angles. In particular, if the corners of the slabs are formed by the junction of two graphite liner portions meeting at a right angle a small flash of metal tends to penetrate into the junction and this forms a knife-like edge which very rapidly damages seals used to prevent water cascading onto the flying saws etc which form part of the conventional handling equipment for continuous casting machines.

It will be seen that the ends of the slabs along the long sides are provided with spring loaded plugs 34 which spring load the ends of the slab portions such as 35 (36 is a load distributing steel shim) to keep the components of the long side fully in contact. The plug 34 is loaded by a spring 37 which is tightened by means of a stud 38 which screws into a screw-threaded recess 39 in the copper body.

It will be seen from FIG. 1 that the channels 9, through which coolant water passes, contain rods such as 40. It is preferred that this arrangement be used because if the rods 40 are not inserted there is an increase in the boundary layer effect such that the coolant water passing through the channels is less effective in removing heat. It has been found that the potential of the coolant water to remove heat is dependent not only upon the velocity but also on the size of the passage through which the water is moving. Rather than use a large number of small channels which might be prone to clogging—and therefore require expensive filtration—use of large passageways with filler rods reduces the pressure drop and still provides for a high heat removal on the part of the coolant water passing through the channels.

The advantage of the arrangement of the invention are numerous. Because the mould is basically a very solid body it is tough and resistant to the normal knocks and impacts which take place in a conventional foundry. Also, because the mould is very substantial it is relatively resistant to distortion which takes place on heating. Since the mould is resistant to distortion the coolant channels can be provided relatively closely to the graphite slabs which form the lining. This increases significantly the cooling ability of the mould. If water were to be passed on to the outside of the copper body rather than passing through the copper body there would be an additional distance of several inches through which heat would have to pass before it could be removed. This would then reduce the thermal efficiency of the mould and reduce production rate. If a thinner mould body were used with water on the outside it would not be as resistant to distortion and damage.

If the mould body were to be provided with arrangements to restrain the graphite liners only at their upper and lower ends there would be inevitably a danger of increasing the air gap which forms between the graphite and the copper body. This can dramatically increase the resistance of the mould to the transfer of heat through it. As has been mentioned above the thermal conductivity of copper is approximately 7500 times that of air. Thus an air gap of 0.01 mm would be equivalent to a thickness of copper of 75 mm. Even with the use of helium between the mould and the copper body the presence of the gap would still dramatically decrease the thermal conductivity of the mould and make it less efficient in use.

Because of the arrangement of components the copper body, once manufactured, should last for many years and the graphite lining slabs are relatively easily manufactured, simple to instal and simple to replace when required.

A further point is that graphite has a relatively poor creep strength at elevated temperatures and because of this the springs pull the graphite into even closer contact with the copper body during operation. Thus the mould progressively decreases its thermal resistance during operation. In an arrangement in which the graphite is restrained only at the top and bottom then the creep tends to mean that the graphite moves away from the copper body and the thermal conductivity of the mould decreases. It can be seen, therefore, that the resilient nature of the retaining means to hold the slabs in contact with the bodies is important.

It will be appreciated that the mould of the invention uniquely deals with all of the potential barriers to heat transfer which it is now realised significantly affect the efficiency of a continuous casting mold. Firstly the reciprocation, together with the tapered mould, deals with volume changes which occur on solidification and as the slab material being cast cools. Since the mould is forced up in part of the reciprocation the taper tends to jam onto the solidifying metal increasing heat transfer. The resilient nature of the springs which provide the contact between the slab lining and the body of the mould reduces the copper to graphite air gap. The arrangement also enables relatively thin graphite to be used which means that the overall thermal resistance of the graphite is kept to a minimum. Although the mould uses thick copper slabs because the coolant channels can be provided in the body of the copper this reduces the thickness of copper across which heat is to be transferred. By the provision of coolant passages within the copper, preferably containing the filler rods, the copper to water heat transfer is also improved.

It will be seen therefore that the mould of the invention provides a particularly useful continuous casting mould which enables metal such as copper to be continuously cast economically and at a high rate.

I claim:

1. A slab mould for a continuous casting machine including a body of a metal having high conductivity, means to cool the body, the body having an internal cavity in which is located a series of graphite slab liner members, characterised in that the graphite slab liner members are resiliently held with their back faces in contact with the body by a plurality of spring-biased means secured to each of the graphite slab liner members over the area of each slab, said spring-biased means cooperating only with the back face of each slab.

2. A mould as claimed in claim 1 in which the body is formed of copper.

3. A mould as claimed in claim 1 in which the distance between adjacent spring-biased means is in the region of 2–4 in.

4. A mould as claimed in claim 1 in which the cross-sectional area of the interior of the mould is smaller at the exit end than at the inlet end.

5. A mould as claimed in claim 4 in which the slab liner members are tapered in thickness to provide the smaller cross-sectional area at the exit end.

6. A mould as claimed in claim 1 in which there are channels in the body or slab liner members to permit a purge gas to be fed to the graphite/body interface.

7. A mould as claimed in claim 1 in which the means to cool the body comprises coolant channels within the body.

8. A mould as claimed in claim 7 in which the coolant channels terminate at the bottom of the mould so that emergent liquid may spray onto the emerging solidified slab.

9. A mould as claimed in claim 7 wherein the coolant channels contain rods spaced from the walls of the channel.

10. A slab mould for a continuous casting machine comprising a body of a metal having high conductivity, means to cool the body, the body having an internal cavity in which is located a series of graphite slab liner members, and a plurality of spring-biased means secured between the metal body and each of the graphite slab liner members over the area of each slab liner member for resiliently holding each slab liner member in contact with the body, said spring-biased means including rod members passing through holes in the body and screwed into tapped blind holes in the back faces of the slab liner members and springs permitting relative movement between the rods and the body.

11. A mould as claimed in claim 10 in which interface pressure between the body and the graphite slab liner members is in the region of 1–5 $lbf/in^2$.

12. A mould as claimed in claim 11 wherein the interface pressure is in the region $1\frac{1}{2}$ to $3\frac{1}{2}$ $lbf/in^2$.

13. A mould as claimed in claim 10 wherein the resilient means comprises nuts compressing coil springs.

14. In a mould for use in the continuous casting of copper into strands, wherein graphite liner members are secured at their back faces within a copper body to define an open ended cavity having a melt entrance and a casting exit, the copper body having conduits in it for cooling water, the improvement which comprises a plurality of fasteners secured to the back face of each of the graphite liner members over the area of each graphite liner member and interengaged with the copper body, each fastener having spring means operating to create an interfacial pressure between the graphite liner member and the copper body.

15. A slab mould for a continuous casting machine comprising a body of a metal having high conductivity, means to cool the body, the body having a rectangular internal cavity in which is located a series of graphite slab liner members arranged on the major axis, the graphite slab liner members being resiliently held in contact with the body by a plurality of spring-biased means secured to each of the graphite slab liner members over the area of each slab liner member, and resilient biassing means end loading the slab liner members to maintain intimate contact of the plurality of graphite slab liner members.

16. A mould as claimed in claim 15 in which the corner portions on the major axis slabs are of L-shape in plan with an internally radiussed corner.

* * * * *